United States Patent [19]

Thomas

[11] 4,022,436

[45] May 10, 1977

[54] SECTIONAL SUPPORT FENCE

[76] Inventor: Ramon L. Thomas, 1007 Menlo, Sioux Falls, S. Dak. 57105

[22] Filed: Jan. 19, 1976

[21] Appl. No.: 650,550

[52] U.S. Cl. ..... 256/24; 256/73; 47/47

[51] Int. Cl.[2] ..... E04H 17/16

[58] Field of Search ..... 256/19, 25, 24, 73; 24/201 R; 46/30, 31; 52/660, 581; 47/44, 45, 46, 47, 33

[56] References Cited

UNITED STATES PATENTS

| | | | |
|---|---|---|---|
| 2,972,833 | 2/1961 | Grutta | 46/30 X |
| 3,537,687 | 11/1970 | Adelman | 256/24 X |
| 3,711,066 | 1/1973 | Niemiec | 256/24 X |
| 3,837,049 | 9/1974 | Corrado | 24/201 R X |
| D188,112 | 6/1960 | Winograd et al. | 256/19 |

*Primary Examiner*—Andrew V. Kundrat

[57] ABSTRACT

A sectional fence composed of a lattice of bars running horizontally and vertically. The ends of at least some of the bars are formed with connector forms such that one end of the bar can be connected to its opposite end to form a cylindrical fence, such connector forms also being thereby connectible to similar connectors on other sections of fence to build up a larger fence by sections either horizontally or vertically.

4 Claims, 5 Drawing Figures

SECTIONAL SUPPORT FENCE

BACKGROUND AND SUMMARY OF THE INVENTION

This invention pertains to sectional fence members and more particularly to a fence preferably made of a plastic material and having bars connectible end to end such that the fence may be built up of sections.

Some plants such as peonies, tomatoes and the like often need support to prevent their branches from hanging down onto the ground. Other plants, when small may need protection from dogs, cats or similar animals. Such support or protection can well be supplied by a fence of some sort bent to a substantially cylindrical shape and disposed around the base of the plant.

Wire fence may be used, but it is often clumsy to handle because the wire takes a permanent set when it is bent and then must be re-bent to another shape when a different diameter of cylinder is needed. Further, the ends of the fence must also be fastened together; usually by bending a wire and fastening it to both ends of the piece of fence or by some other semi-permanent means. A further disadvantage of the wire fence is that its height is relatively fixed and can be varied only by using a different piece having a different dimension.

By my invention I provide a sectional fence having a series of pieces which may be fastened together both vertically and horizontally to provide for a variety of sizes. The pieces are formed with horizontal and vertical bars, at least some of which have connectors formed at each end. These connectors can be fastened either to their counterpart on the opposite end of the same bar to provide a cylindrical formation, or to a counterpart fastener on an end of a similar bar on another section to provide an extended fence. Since the connectors are on both the horizontal and vertical bars, I can build my fence either horizontally or vertically or both directions.

FIGURES

DESCRIPTION

Briefly my invention comprises a sectional fence adapted to be built up in sections and the particular connections used to hold the sections together.

Figure 1:
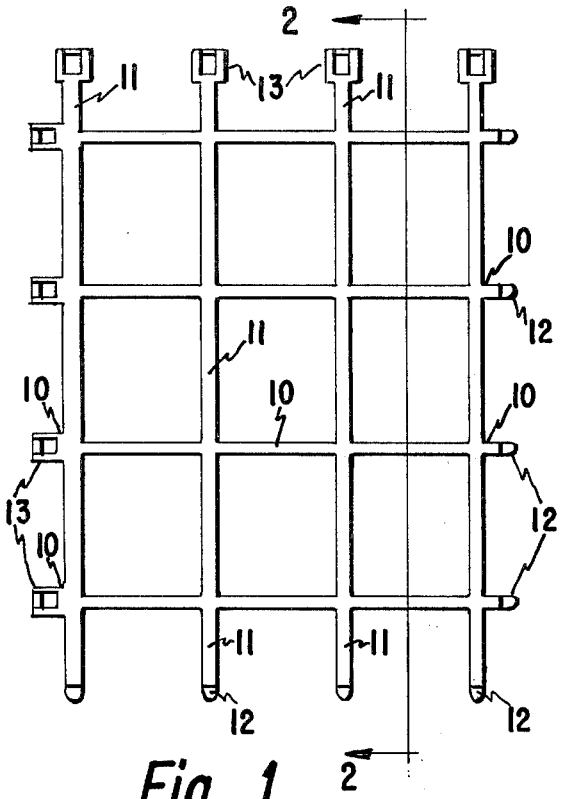
FIG. 1 is a plan view of a single section of my fence, laid out flat.
Figure 2:
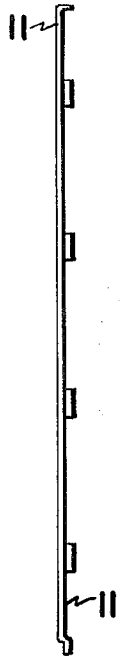
FIG. 2 is a view from line 2—2 of FIG. 1.
Figure 3:
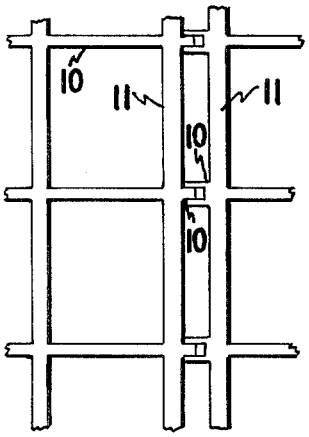
FIG. 3 is a partial view showing the connectors at opposite ends of the bar in engagement.
Figure 4:
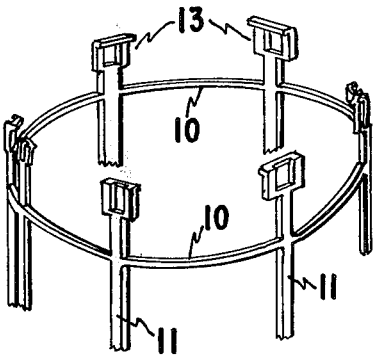
FIG. 4 is a partial view of one section of fence drawn up into cylindrical form and connected.

More particularly, and referring to the drawings, my fence is built up of sections, each section having at its vertical edges a series of horizontal bars 10 and along the horizontal top and bottom edges a series of vertical bars 11. Although I illustrate these bars 10 and 11 as running completely across the section, it will be obvious that any sort of design other than the illustrated rectangular lattice could be used to constitute the fence section. The entire section is preferably formed of a molded plastic material which may be readily flexed as shown in FIG. 4.

In order to attach the sections together, I provide a series of connectors at the opposite ends of several of the bars 10 and 11. I illustrate a connector on each bar, but again it will be obvious that if the bars were closely spaced, connectors could be provided on the ends of every alternate bar without going beyond the invention.

Figure 5:
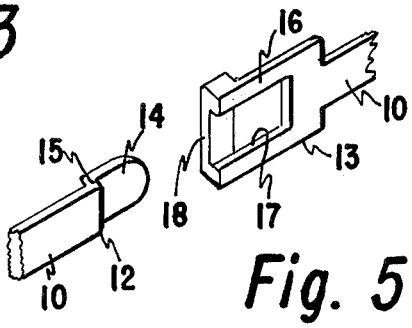
FIG. 5 is a detailed view of the elements of the connectors in a disengaged position.

The connectors are formed of a male end 12 and a female end 13 as best shown in FIG. 5. The male end is simply an extension of the bar 10 or 11 having the tip 14 offset from the principal bar by about the thickness of the bar and connected to the bar 10 by a web 15.

The female end 13 is an enlarged pad 16 formed on the end of the bar 10 opposite the male end 12. The pad 16 is shaped to provide a rectangular opening 17 adapted to receive the male end 12. The outer wall of the opening is a cross piece 18 again offset from the level of the pad 16 by about the thickness of the material in the bar 10 and the pad 16.

Thus, when the connector is engaged, the tip 14 is inserted into the opening 17. The tip is longer than the opening, so that the end will engage the rear surface of the pad 16 when the web 15 abuts the edge of the cross piece 18. In that engaged position, the abutment of the web 15 against the cross piece 18 prevents longitudinal disengagement. Further, the side walls of the opening 17 will engage at least a short length of the edges of the bar 10 adjacent the web 15 so that the bars are held in alignment. Also, by careful proportioning, the fit of those edges between the side walls can be made close enough so that they are frictionally engaged and thus are held in place by that kind of frictional engagement.

It is not necessary to connect the opposite ends of a single section together. It will be apparent that a male end 12 on one section can be connected to a female end 13 on another section, and that larger pieces of fence may be built up in this way. Thus, if a low ring of fairly large diameter is desired, a plurality of sections may be built up horizontally and then curved into a cylinder and fastened in that position. Or if it is desired to support, or to protect the trunk of a small tree, it is possible to build vertically and then curve the sections into a relatively long vertical tube. Or the fence could also be used in straight sections. Whichever way the fence is used, I prefer to form the tip 14 of the male end 12 with a pointed or rounded end which can be more readily pressed into the ground on which the fence is to stand, thus providing some added stability for the fence.

I claim:

1. A piece of fence comprising a fence section of substantially rectangular shape having a top and bottom edge and two lateral ends, said section having a plurality of bars extending from said top and bottom edges and from said lateral ends, complementary mating parts being formed on said bars so that one of said parts is in one end of a bar and the mating part is on the end of the bar opposite to this first-named bar whereby said section can be formed into a cylindrical form by connecting said mating parts together and can also be connected on all four sides to an added section of similar form.

2. The device of claim 1 in which said mating parts comprise a male part of one bar and a matching female end on an opposite bar, said male part including an offset tip and said female end including a pad formed to provide an opening into which said male end may be inserted, the outer wall of said opening being formed by an offset cross piece engageable with said offset tip.

3. The device of claim 2 in which said opening has side walls and said male part has edges engaged with said side walls in a snug fit such that frictional engagement tends to hold said male and female parts in an engaged position.

4. The device of claim 2 in which said offset tip is of such length that it extends beyond said opening when said cross piece and the offset of said tip are engaged in holding position.

* * * * *